US010465354B2

(12) United States Patent
Beckhusen

(10) Patent No.: US 10,465,354 B2
(45) Date of Patent: Nov. 5, 2019

(54) HYDRAULIC FLUID SYSTEMS FOR MACHINE IMPLEMENTS

(71) Applicant: Caterpillar Inc., Peoria, IL (US)

(72) Inventor: Jordan Beckhusen, Robinson, TX (US)

(73) Assignee: Caterpillar Inc., Peoria, IL (US)

( * ) Notice: Subject to any disclaimer, the term of this patent is extended or adjusted under 35 U.S.C. 154(b) by 210 days.

(21) Appl. No.: 15/380,638

(22) Filed: Dec. 15, 2016

(65) Prior Publication Data

US 2018/0172031 A1 Jun. 21, 2018

(51) Int. Cl.

| | |
|---|---|
| ***F15B 13/02*** | (2006.01) |
| ***E02D 3/074*** | (2006.01) |
| ***E01C 19/28*** | (2006.01) |
| ***E02F 3/96*** | (2006.01) |

(52) U.S. Cl.

CPC ..... *E02D 3/074* (2013.01); *E01C 19/286* (2013.01); *E02F 3/967* (2013.01)

(58) Field of Classification Search

CPC ..... F15B 13/0401; F15B 11/10; F15B 13/02; F15B 13/0807; F15B 13/0842; E01C 19/38; E02D 3/046; H02K 7/14

USPC ..... 137/596

See application file for complete search history.

(56) References Cited

U.S. PATENT DOCUMENTS 3,561,336 A * 2/1971 Century ..... E02D 3/074 404/133.2
3,760,691 A 9/1973 Kleckner et al.
3,863,449 A * 2/1975 White, Jr. ..... B62D 5/097 418/61.3
3,917,426 A * 11/1975 Wohlwend ..... B06B 1/16 404/113
4,144,799 A * 3/1979 Ponchaux ..... F01B 1/0631 91/488
4,224,003 A * 9/1980 St. Louis ..... E02D 3/046 37/904
4,367,054 A 1/1983 Salani et al.
4,462,773 A * 7/1984 Erasov ..... F16J 15/3496 418/104
4,586,885 A * 5/1986 Middlekauff ..... F01C 11/002 418/61.3
4,759,659 A 7/1988 Copie
(Continued)

FOREIGN PATENT DOCUMENTS

CN 102839589 A 12/2012
CN 202744926 U 2/2013
(Continued)

*Primary Examiner* — Minh Q Le
(74) *Attorney, Agent, or Firm* — Miller, Matthias & Hull

(57) ABSTRACT

A hydraulic fluid system is provided for a work implement having a support plate, the work implement being provided on a machine having an auxiliary hydraulic fluid supply line and an auxiliary hydraulic fluid return line. The hydraulic fluid system includes a motor having an inlet port and an outlet port, and a mounting plate coupled to the support plate of the implement. The mounting plate further defines a supply conduit configured to fluidly communicate between the auxiliary hydraulic fluid supply line and the inlet port of the motor, and a return conduit fluidly communicating between the outlet port of the motor and the auxiliary hydraulic fluid return line. A kit and a method for retrofitting a hydraulic fluid system are also disclosed.

17 Claims, 9 Drawing Sheets

(56) References Cited

U.S. PATENT DOCUMENTS 4,877,383 A * 10/1989 White, Jr. ..... F04C 2/105 418/61.3
4,976,594 A * 12/1990 Bernstrom ..... F01C 21/003 418/133
5,137,438 A 8/1992 Miller
5,181,837 A * 1/1993 Niemiec ..... F04B 1/20 417/205
5,220,845 A * 6/1993 Anderson ..... E02D 3/02 184/13.1
5,396,768 A 3/1995 Zulu
5,713,418 A * 2/1998 Warren ..... E01C 19/38 172/40
6,241,420 B1 6/2001 Perrin et al.
6,672,843 B1 * 1/2004 Holder ..... F04B 1/22 417/201
6,783,339 B2 8/2004 Dong et al.
6,848,255 B2 * 2/2005 Chiaramonte ..... F01P 7/044 60/456
7,621,112 B2 11/2009 Slattery et al.
7,739,870 B2 6/2010 Carlson et al.
8,635,867 B2 1/2014 Dong et al.
8,935,920 B2 1/2015 Olson et al.
9,151,374 B2 10/2015 Richardson et al.
2005/0133102 A1 * 6/2005 Blackman ..... F15B 13/0814 137/884
2005/0247504 A1 * 11/2005 Gleasman ..... B60K 17/105 180/307
2010/0189501 A1 7/2010 Grabnic et al.
2017/0009407 A1 * 1/2017 Beckhusen ..... E01C 19/38

FOREIGN PATENT DOCUMENTS

CN 202991688 U 6/2013
WO 0200359 A1 1/2002

* cited by examiner

HYDRAULIC FLUID SYSTEMS FOR MACHINE IMPLEMENTS

FIELD OF THE DISCLOSURE

The present disclosure relates generally to machine implements, such as vibratory plate compactors, and more particularly to hydraulic fluid systems for such implements.

BACKGROUND OF THE DISCLOSURE

Machine implements such as vibratory compactors are often used in construction and other industries to compact soil, roadway base, paving material, or other work surfaces. In certain applications, the implement is provided as an accessory that is attached to a mobile machine, such as an excavator. The machine typically has its own hydraulic circuit for operating components provided on the machine. For example, the hydraulic circuit of the machine may be connected to hydraulic actuators for operating tracks or other ground engaging units to move the machine over the surface. Additionally, the hydraulic circuit may be coupled to hydraulic cylinders that operate the boom, stick, or other component of the machine. The hydraulic circuit of the machine may also have auxiliary connections, such as a high pressure supply line and a low pressure return line, for attachment to the implement.

The implement, in turn, includes a hydraulic system for routing hydraulic fluid through the implement, thereby to operate the implement. In a vibratory compactor, for example, the hydraulic system includes a primary line coupled to a motor having an inlet and an outlet fluidly coupled to the supply and return lines, respectively, of the machine. The motor may be connected to a vibration mechanism, such as a rotatable shaft carrying an eccentric weight, so that fluid flow through the primary line rotates the shaft to produce a vibratory force. The hydraulic system may include additional lines, such as a bypass line, pressure relief line, and anti-cavitation line, to perform other functions.

In conventional implements, the primary and additional lines are typically provided in a manifold that is located remotely from the motor. For example, the motor may be mounted on a vibratory plate, while the manifold is mounted on a yoke coupled to the plate. Consequently, additional hoses are required to connect the manifold to the pump. Additionally, in some implements, a primary check valve is provided in the primary line to ensure that hydraulic fluid flows only in the intended direction. This check valve is also typically provided in the remotely located manifold.

A hydrostatic transmission for a riding lawn tractor is disclosed in U.S. Pat. No. 7,739,870 entitled, "Hydrostatic Transmission" (hereinafter the '870 patent). The '870 patent discloses a hydrostatic transmission module 14 that includes a single housing that integrates and houses all of the components of the hydrostatic transmission. Specifically, a cover 74 of the transmission module 14 has an integral fluid flow path that forms a part of the hydraulic circuit. While incorporating some of the hydraulic circuit into the cover 74 may reduce complexity of the hydraulic circuit, it nevertheless requires intricate and complex machining of the housing, thereby raising fabrication costs, and yet provides only an extremely limited amount of space for the integrating hydrostatic transmission components.

SUMMARY OF THE DISCLOSURE

In accordance with one embodiment, a hydraulic fluid system is provided for a work implement having a support plate, the work implement being provided on a machine having an auxiliary hydraulic fluid supply line and an auxiliary hydraulic fluid return line. The hydraulic fluid system includes a motor having an inlet port and an outlet port, and a mounting plate coupled to the support plate of the implement. The mounting plate further includes a body defining an exterior surface including a mounting portion coupled to the motor, a supply conduit extending through the body from a first supply port, formed in the exterior surface and configured to fluidly communicate with the auxiliary hydraulic fluid supply line, to a second supply port, formed in the exterior surface and coupled to the inlet port of the motor, and a return conduit extending through the body from a first return port, formed in the exterior surface and coupled to the outlet port of the motor, and a second return port, formed in the exterior surface and configured to fluidly communicate with the auxiliary hydraulic fluid return line.

In accordance with another embodiment, a kit is provided for retrofitting a hydraulic fluid system for a work implement, the hydraulic fluid system including an existing motor coupled to a support plate of the work implement, the work implement being configured for use with a machine having an auxiliary hydraulic fluid supply line and an auxiliary hydraulic fluid return line. The kit includes a mounting plate configured for coupling to the support plate of the implement, the mounting plate including a body defining an exterior surface including a mounting portion configured for coupling to the existing motor, a supply conduit extending through the body from a first supply port, formed in the exterior surface and configured to fluidly communicate with the auxiliary hydraulic fluid supply line, to a second supply port, formed in the exterior surface and positioned to directly couple to an inlet port of the existing motor, and a return conduit extending through the body from a first return port, formed in the exterior surface and positioned to directly couple to an outlet port of the existing motor, and a second return port, formed in the exterior surface and configured to fluidly communicate with the auxiliary hydraulic fluid return line.

In accordance with a further embodiment, a method is provided of retro-fitting a hydraulic work implement having a support plate and provided on a machine having an auxiliary hydraulic fluid supply line and an auxiliary hydraulic fluid return line. The method includes removing an existing implement hydraulic manifold from the work implement, removing an existing motor mount from the support plate of the work implement, and detaching an existing motor from the existing motor mount. A new mounting plate is installed onto the support plate of the implement, the new mounting plate including a body defining an exterior surface including a mounting surface, a supply conduit extending through the body from a first supply port formed in the exterior surface to a second supply port formed in the exterior surface, and a return conduit extending through the body from a first return port formed in the exterior surface to a second return port formed in the exterior surface. The method further includes attaching the existing motor to the mounting surface of the body of the new mounting plate, so that the second supply port is directly coupled to an inlet port of the existing motor and the first return port is directly coupled to an outlet port of the existing motor.

These and other aspects and features of the present disclosure will be more readily understood upon reading the following detailed description in conjunction with the accompanying drawings.

DETAILED DESCRIPTION

Embodiments of hydraulic fluid systems for work implements provided with machines are disclosed. In the illustrated embodiments, the work implements are described as vibratory plate compactors, however the advantages taught herein may be used with other types of work implements. Additionally, the machine is shown as an excavator, however other types of machines may be used as long as the machine includes a hydraulic circuit for use by the work implement. The hydraulic fluid systems disclosed herein include a mounting plate having integrated hydraulic fluid conduits, thereby simplifying connection of the work implement to the hydraulic circuit provided on the machine, reducing the number of flexible conduits (i.e., hoses) typically required on the work implement, and eliminating the need for an externally mounted and independently provided hydraulic manifold. In some embodiments, a rotatable shaft that carries an eccentric weight of the vibratory plate compactor may form part of the hydraulic circuit, and hydraulic components, such as a check valve, may be incorporated into the shaft to further reduce external connections or other structures typically provided with the work implement.

Figure 1:
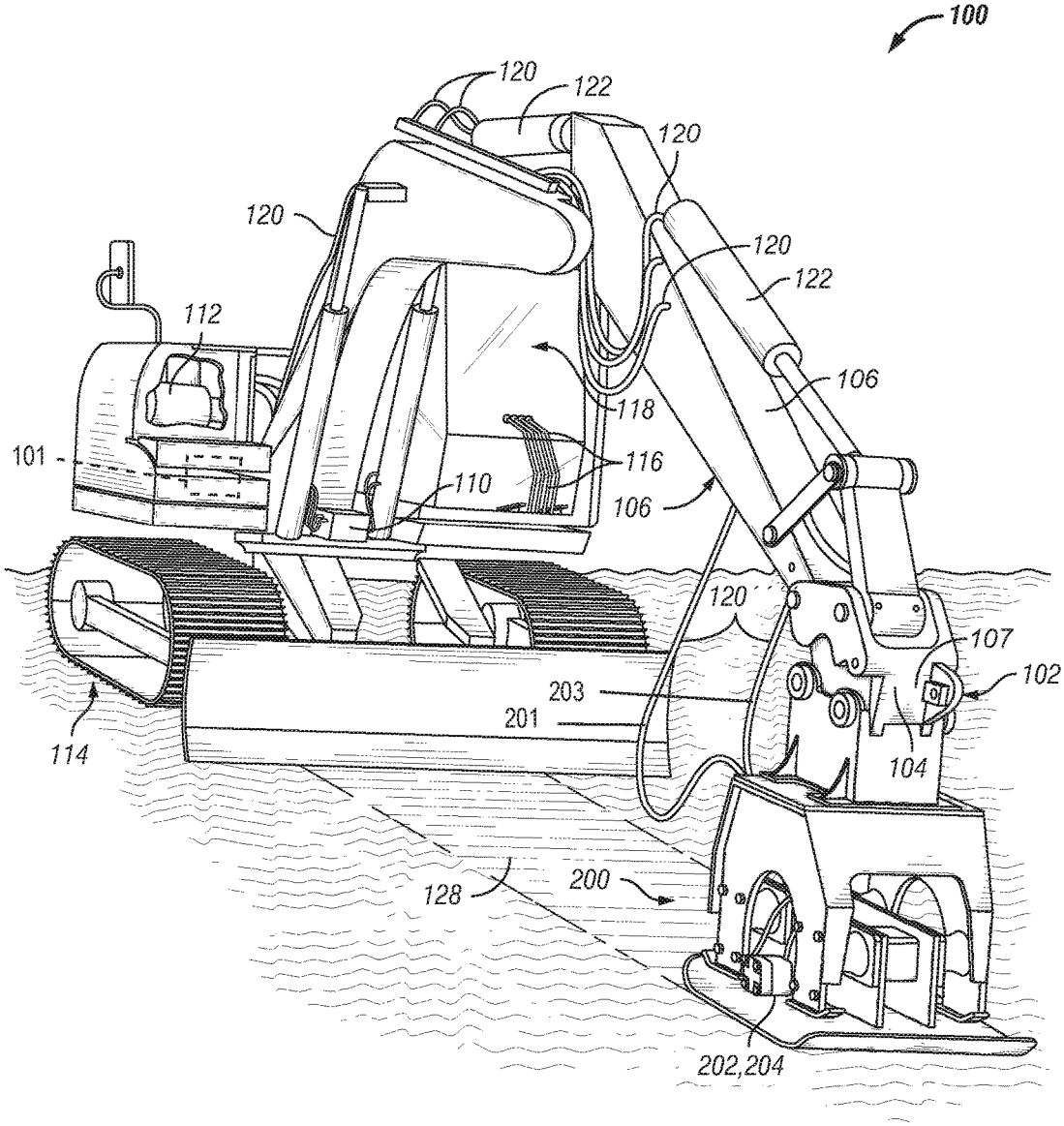
FIG. 1 is a perspective view of a machine having a work implement in the form of a vibratory plate compactor assembly.

Referring now to the drawings and with specific reference to FIG. 1, a perspective view is shown of a machine 100 having an implement in the form of a vibratory plate compactor assembly 200 attached thereto. The vibratory plate compactor assembly 200 is shown compacting a work surface 128 containing densifiable strata, such as ground soil, road base material, or paving material. A coupling device 102 may be provided to facilitate attachment of the vibratory plate compactor assembly 200 to the machine 100. The machine 100 further comprises a controller 110, a motor 112, and a wheel or track undercarriage 114 that is driven by the motor 112. The controller 110 is in communication or operative association with the controls 116 provided in the cab 118 so that the operator may control the movement and function of various parts and systems of the machine 100 and the vibratory plate compactor assembly 200.

While the machine 100 is depicted in FIG. 1 as a large excavator, it will be appreciated that the machine may be provided in other forms, such as a backhoe and the like. Furthermore, while the machine 100 is depicted as having a track driven undercarriage 114, other types of ground engaging units, such as wheels or tires, may also be used. The motor 112 of the machine 100 may be an internal combustion engine, electric motor, battery, or other device.

The machine 100 includes a hydraulic circuit for operating various systems on the machine. For example, the hydraulic circuit includes a pump 101 fluidly communicating through hydraulic hoses 120 to multiple cylinders 122 used to move a boom 105, stick 106, and implement linkage 107 of the machine 100. The hydraulic circuit of the machine 100 further includes auxiliary hydraulic fluid supply and return hoses 201, 203 for connection to the vibratory plate compactor assembly 200.

Figure 2:
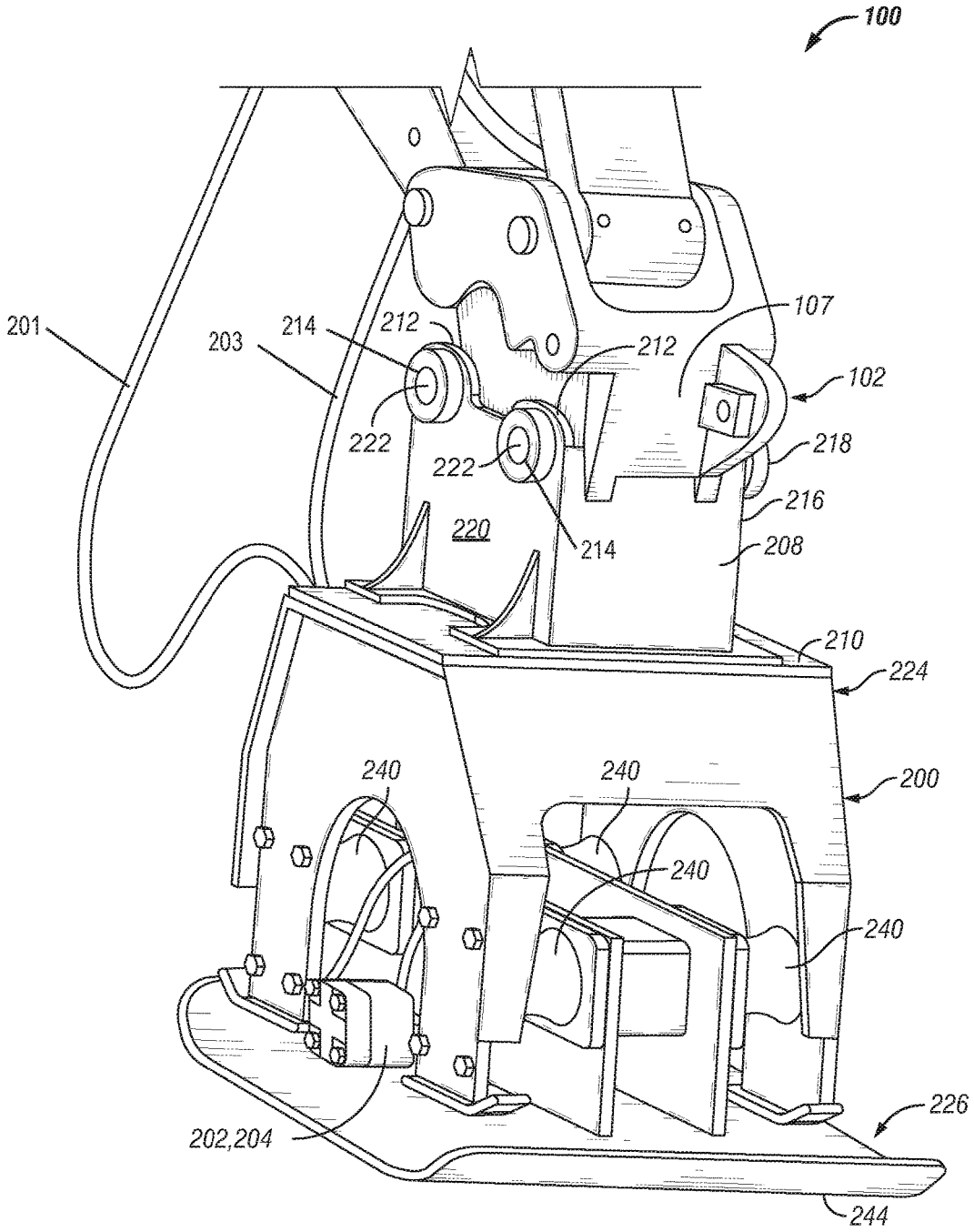
FIG. 2 is an enlarged detail view of the vibratory place compactor assembly of FIG. 1.

Connection of the vibratory plate compactor assembly 200 to the machine 100 is shown in greater detail in FIG. 2. The assembly 200 includes an adapter subassembly 208 attached to a top plate 210. The adapter subassembly 208 includes a first side plate 220 with two ear portions 212 that define pin receiving bores 214 and a second side plate 216 with two ear portions 218 (only one of which can be seen in FIG. 2) that define pin receiving bores that are aligned concentrically with the pin receiving bores 214 of the first side plate 220. Pins 222 extend through the bores 214 to hold the adapter subassembly 208 and vibratory plate compactor assembly 200 to the machine 100. In some embodiments, the coupling device 102 may be a quick change coupling mechanism. Additionally, in some embodiments, the assembly 200 may be permanently attached to the machine 100.

Figure 3:
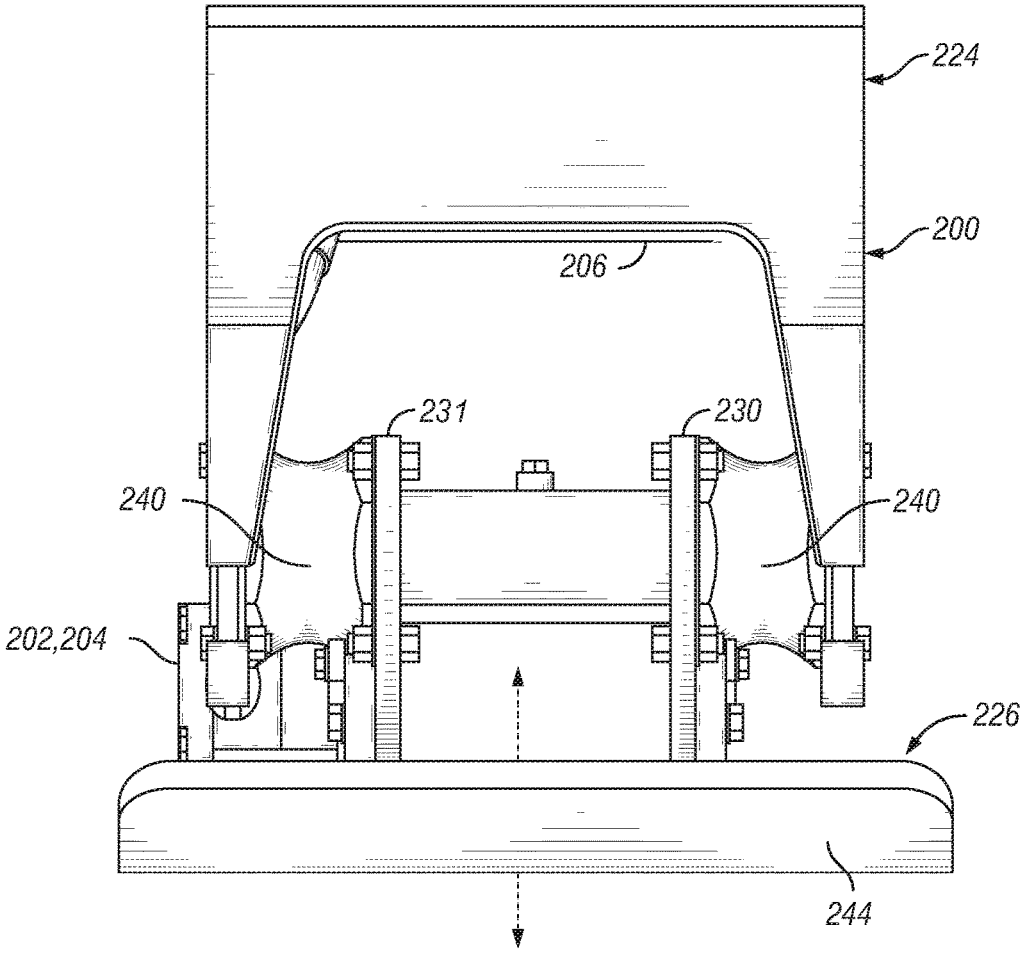
FIG. 3 is a front view of the vibratory plate compactor assembly of FIGS. 1 and 2.

Now referring to FIGS. 2 and 3, the vibratory plate compactor assembly 200 comprises an upper portion 224, a lower portion 226 that is movably attached to the upper portion 224 and includes a compacting plate 244, a vibration mechanism 202 operatively associated with the lower portion 226 for vibrating the lower portion 226, and a plurality of isolation mounts 240. The vibration mechanism 202 is supported in the bores of support plates 230, 231 provided with the lower portion 226. Operation of the vibration mechanism 202 causes the lower portion 226 to vibrate or oscillate relative to the upper portion 224. When the compacting plate 244 is positioned on or above the work surface 128, oscillation of the lower portion 226 engages and compacts the densifiable strata that form the work surface 128.

Figure 4:
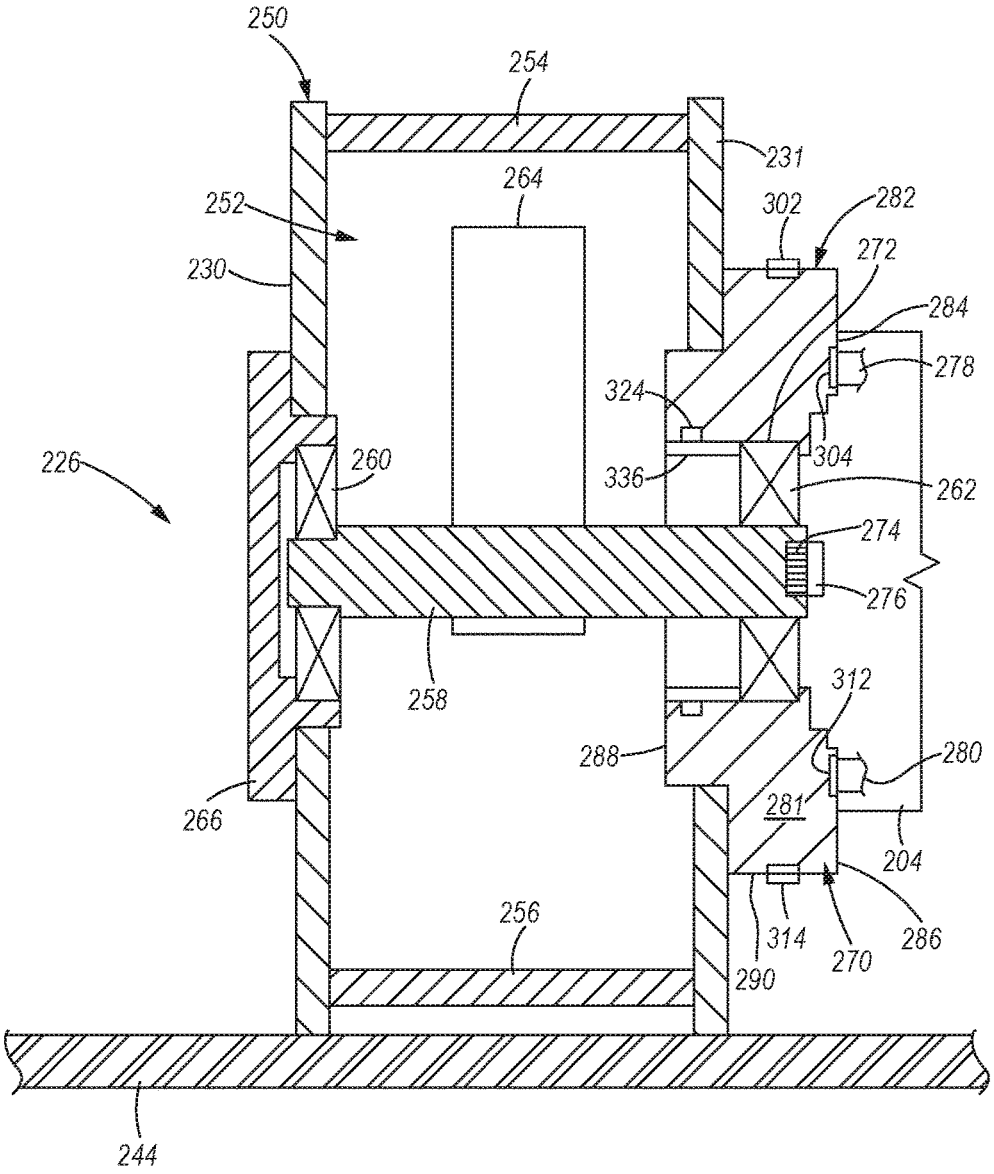
FIG. 4 is a side view, in partial cross-section, of the vibratory plate compactor assembly of FIGS. 1-3.

FIG. 4 illustrates the lower portion 226 of the vibratory plate compactor assembly 200 in greater detail. A housing 250 defining a chamber 252 is formed by the support plates 230, 231, an upper wall 254, and a lower wall 256. A shaft 258 extends through the housing 250 and is supported for rotation by bearings 260, 262. An eccentric weight 264 is coupled to the shaft 258 to generate a vibrational force when rotated. A bearing cap 266 is attached to and closes off the support plate 230, and supports the bearing 260 at one end of the shaft 258. A mounting plate 270 is attached to the support plate 231 and supports the bearing 262 provided at an opposite end of the shaft 258. The shaft 258 extends at least partially through a central bore 272 formed in the mounting plate 270 and is configured, such as by internal splines 274, for coupling to an output shaft 276 of a motor 204. The motor 204 further includes an inlet port 278 and an outlet port 280.

Figure 5:
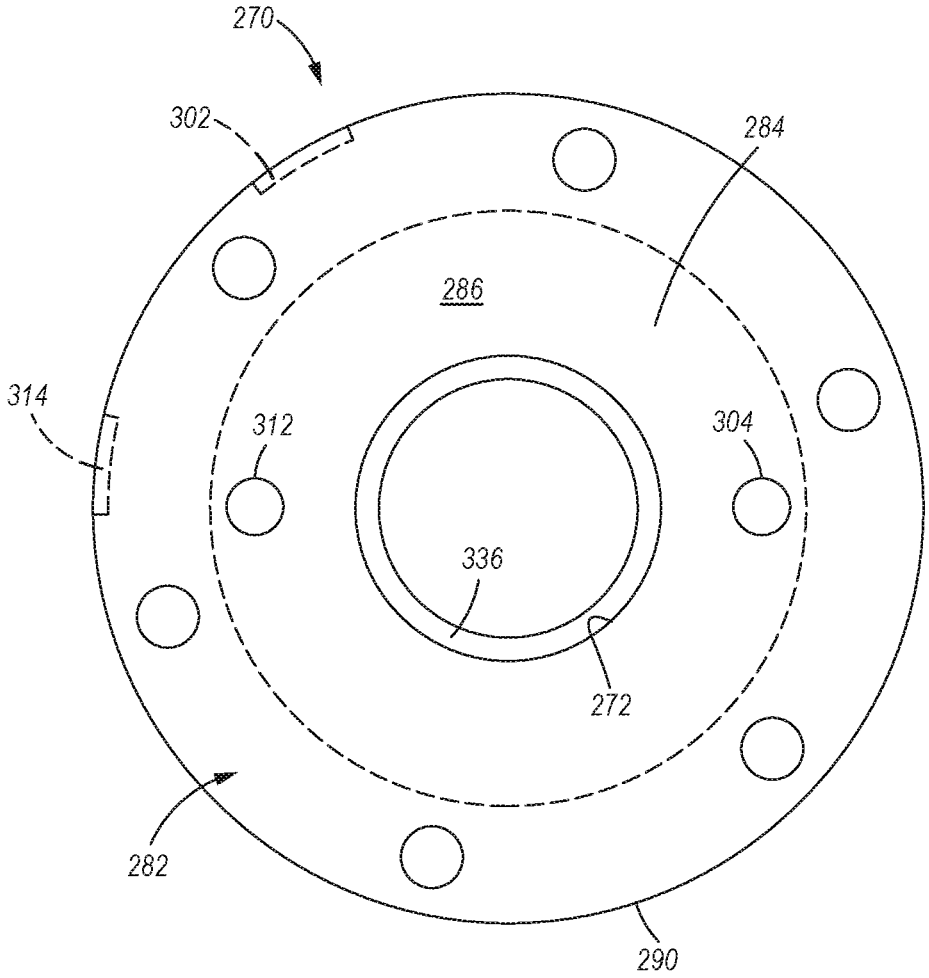
FIG. 5 is to view of a mounting plate provided on the vibratory plate compactor assembly of FIGS. 1-4.
Figure 6:
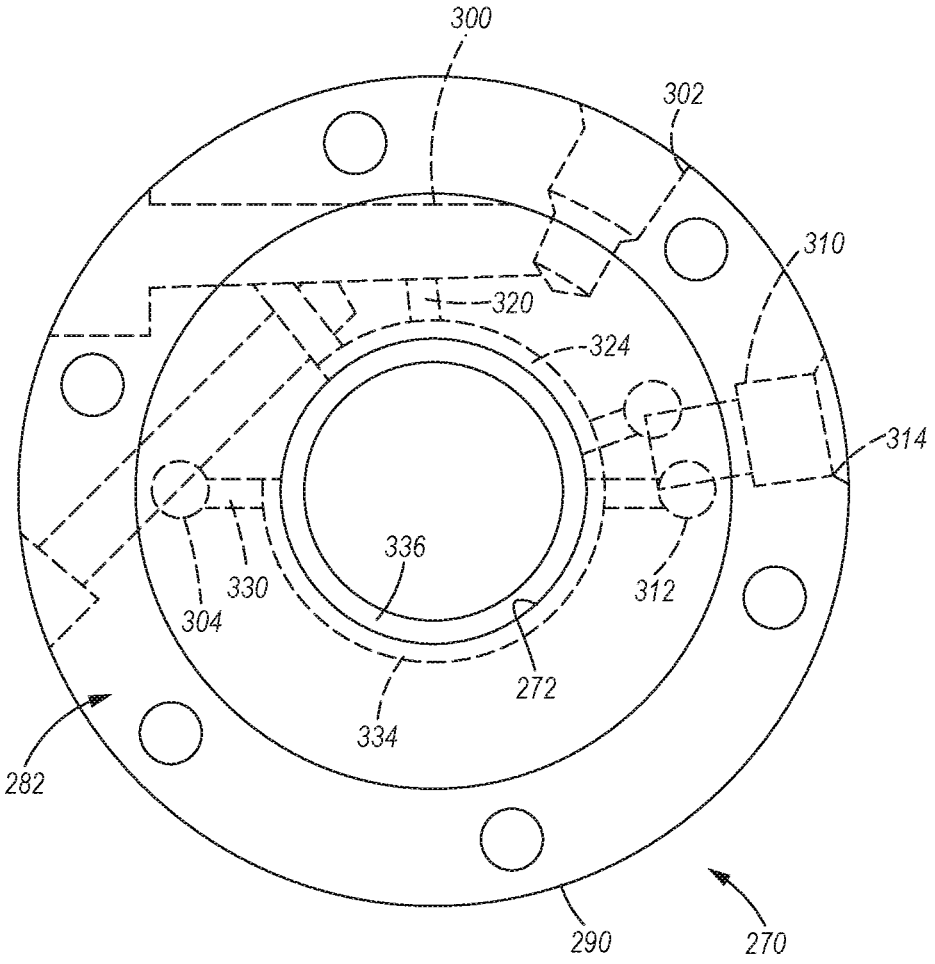
FIG. 6 is a bottom view of the mounting plate of FIG. 5.

The mounting plate 270 secures the motor 204 to the housing 250 and shaft 258. As best shown in FIGS. 4-6, for example, the mounting plate 270 includes a body 281 defining an exterior surface 282 that includes a mounting portion 284 configured for attachment to the motor 204. In the exemplary embodiment, the exterior surface 282 further includes an external face 286 oriented away from the housing 250 and defining the mounting portion 284, and an internal face 288 disposed in the housing 250. The central bore 272 extends through the body 281 from the external face 286 to the internal face 288, and a side wall 290 extends between outer edges of the external and internal faces 286, 288, opposite the central bore 272. When the motor 204 is attached to the mounting plate 270, the output shaft 276 of the motor 204 engages the shaft 258 carrying the eccentric weight 264.

Figure 7:
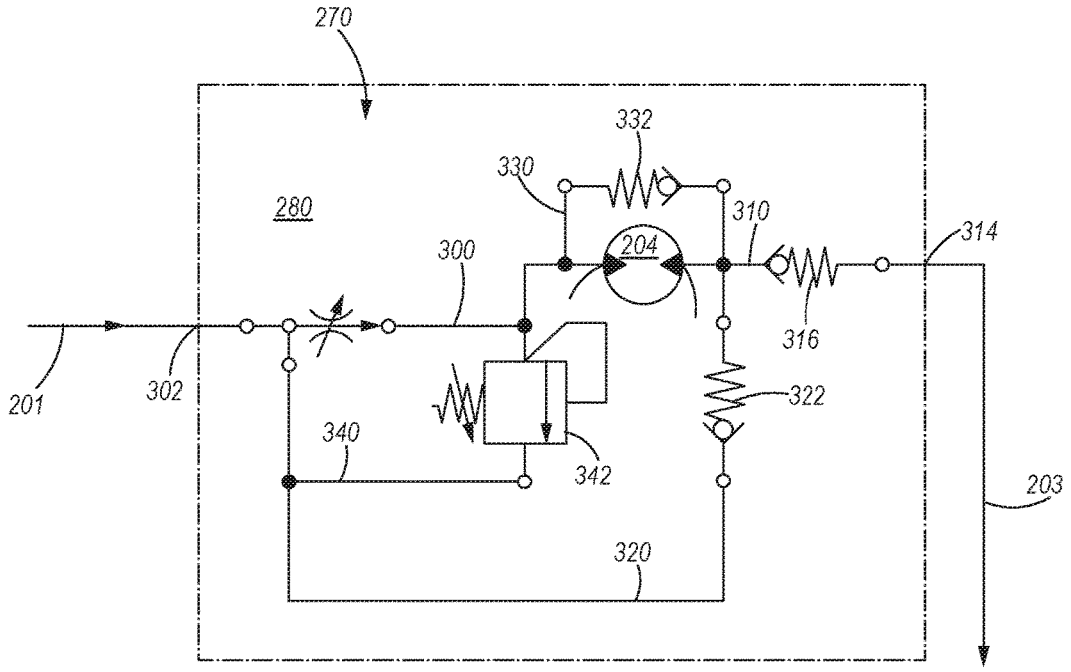
FIG. 7 is a schematic diagram of the mounting plate of FIGS. 5 and 6.

In addition to supporting the motor 204, the mounting plate 270 also forms part of a hydraulic fluid system for the vibratory plate compactor assembly 200 by including integrated conduits through which hydraulic fluid flows. As best shown in FIGS. 6 and 7, a supply conduit 300 extends through the body 281 of the mounting plate 270 from a first supply port 302 to a second supply port 304. The first and second supply ports 302, 304 are formed in the exterior surface 282 of the mounting plate 270, with the first supply port 302 configured to fluidly communicate with the auxiliary hydraulic fluid supply line 201, and the second supply port 302 configured to fluidly communicate with, such as by being directly coupled to, the inlet port 278 of the motor 204.

The mounting plate 270 may also include a return conduit 310 extending through the body 281 of the mounting plate 270 from a first return port 312 to a second return port 314. The first and second return ports 312, 314 are formed in the exterior surface 282 of the mounting plate, with the first return port 312 configured to fluidly communicate with, such as by being directly coupled to, the outlet port 280 of the motor 204, and the second return port 314 configured to fluidly communicate with the auxiliary hydraulic fluid return line 203. A return check valve 316 may be disposed in the return conduit 310 to prevent reverse flow of fluid through the motor 204.

In the embodiment illustrated in FIGS. 5 and 6, the first supply port 302 and the second return port 314 are formed in the side wall 290 of the mounting plate 270, while the second supply port 304 and first return port 312 are formed in the external face 286 of the mounting plate 270, to facilitate hydraulic connection of the motor 204 to the auxiliary hydraulic fluid supply and return lines 201, 203 through the mounting plate 270.

In some embodiments, the mounting plate 270 may incorporate additional hydraulic system components, such as a bypass conduit 320. As best shown in FIGS. 6 and 7, the bypass conduit 320 is formed at least partially in the body 281 of the mounting plate 270 and fluidly communicates between the supply conduit 300 and the return conduit 310. The bypass conduit 320 may include a bypass check valve 322. A first groove 324 (FIGS. 4 and 6) formed in the central bore 272 of the mounting plate 270 may form at least a portion of the bypass conduit 320. Additionally, the mounting plate 270 may include an anti-cavitation conduit 330 for preventing cavitation of the pump. The anti-cavitation conduit 330 is formed at least partially in the body 281 of the mounting plate 270, and fluidly communicates between the supply conduit 300 and the return conduit 310 independent of the bypass conduit 320. The anti-cavitation conduit 330 may include an anti-cavitation check valve 332. A second groove 334 (FIGS. 4 and 6) formed in the central bore 272 of the mounting plate 270 may form at least a portion of the anti-cavitation conduit 330. A bearing sleeve 336 may be inserted into the central bore 272 and sized to closely fit over the central bore 272, thereby to close off the first and second grooves 324, 334.

Still further, the mounting plate 270 may include a pressure relief conduit 340 for relieving overpressure of the hydraulic fluid system. As best shown in FIGS. 6 and 7, the pressure relief conduit 340 extends through the body 281 of the mounting plate 270 and fluidly communicates between the supply conduit 300 and the return conduit 310. A pressure relief valve 342 is disposed in the pressure relief conduit 340.

Figure 8:
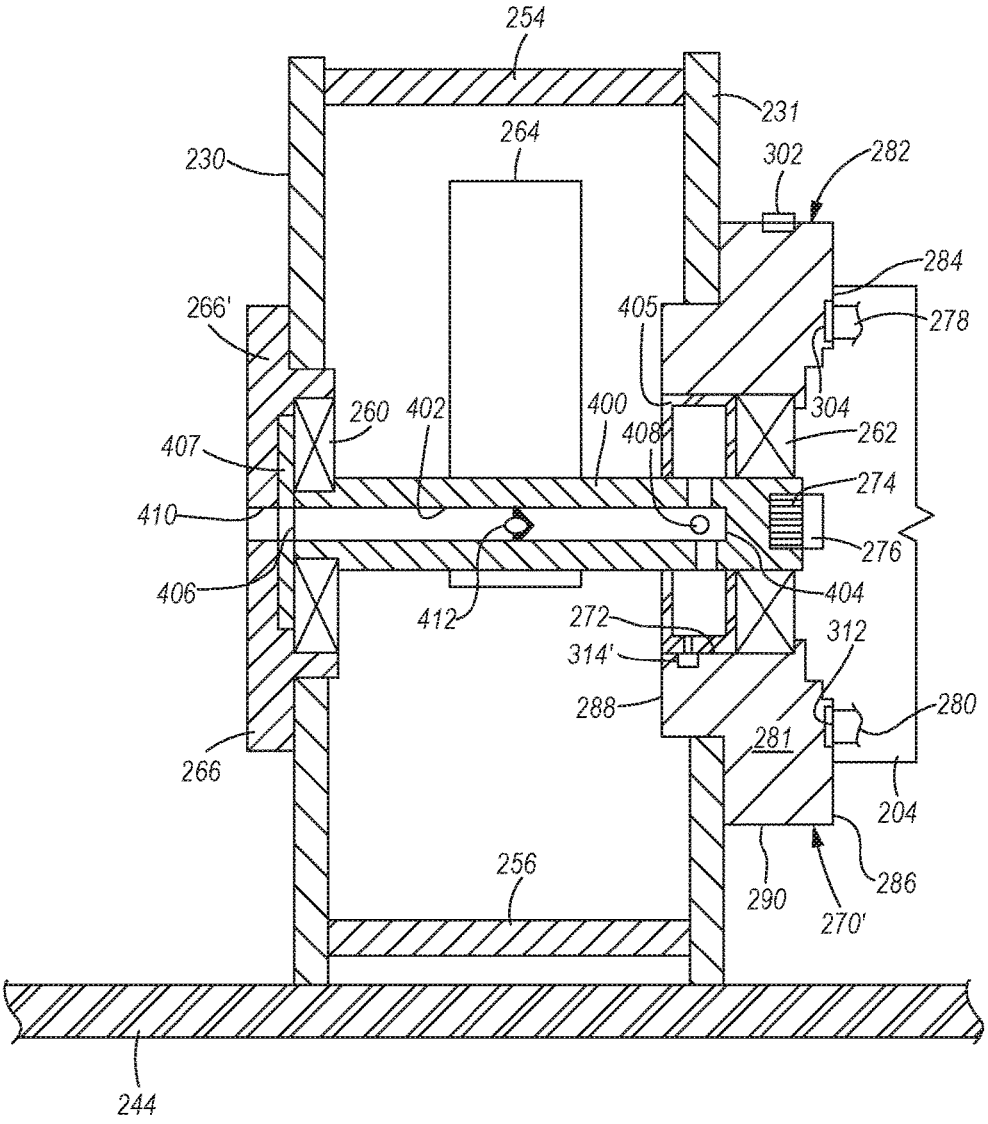
FIG. 8 is a side view, in partial cross-section, of an alternative embodiment of a vibratory plate compactor assembly having a shaft defining a shaft conduit.

In an alternative embodiment illustrated at FIG. 8, the hydraulic fluid system of the vibratory plate compactor assembly 200 may further include a modified shaft 400 for the eccentric weight 264. In this embodiment, the shaft 400 defines a shaft conduit 402 extending from an inlet end 404 to an outlet end 406. The inlet end 404 may include one or more apertures 408. A modified mounting plate 270' may include a second return port 314' located to facilitate fluid communication between the return conduit 310 and the inlet end 404 of the shaft 400, such as by being located on the central bore 272 nearer the internal face 288 of the mounting plate 270. An inlet end shaft seal 405 may be disposed between the mounting plate 270' and the shaft 400 to direct fluid toward the apertures 408 and prevent leakage. The outlet end 406 of the shaft 400 may fluid communicate with the auxiliary hydraulic fluid return line 203, such as through an outlet end shaft seal 407 and cap aperture 410 provided in modified bearing cap 266'. In the illustrated embodiment, a shaft check valve 412 is disposed in the shaft conduit 402 and is configured to permit fluid flow only from the inlet end 404 to the outlet end 406 of the shaft conduit 402. The shaft check valve 412 may take the place of the return check valve 316 in the above embodiment, thereby further reducing the footprint of the mounting plate 270' and the number of hydraulic system components provided outside of the housing 250. Additionally, routing fluid flow through the shaft 400 separates the connection points between the motor and the hydraulic circuit of the machine, thereby providing better hose management and a more intuitive arrangement for the user when connecting the hydraulic system of the implement to the hydraulic circuit machine.

While the above embodiments may be used in newly constructed work implements, it will further be appreciated that the advantages disclosed herein may be used in retro-fit applications as well. Accordingly, a kit for retrofitting a hydraulic fluid system for a work implement may include a mounting plate 270, 270', as described above, configured for coupling to an existing motor 204. In some embodiments, the kit may further include the shaft 400, with or without the shaft check valve 412. In still further embodiments, the kit may include a new motor 204 for replacing the existing motor 204, in which case the mounting portion 284 of the mounting plate 270, 270' is further configured for coupling to the new motor, the second supply port 304 is positioned to directly couple to an inlet port 278 of the new motor 204, and the first return port 312 is positioned to directly couple to an outlet port 279 of the new motor 294.

INDUSTRIAL APPLICABILITY

Embodiments of mounting plates 270, 270' are disclosed that perform the dual functions of supporting a motor 204 and providing portions of a hydraulic fluid system for a work implement. The mounting plates 270, 270' incorporate one or more integrated fluid conduits that permit direct connection of the mounting plate 270, 270' to the inlet and outlet ports 278, 280 of the motor 204, thereby reducing the number of hoses needed to connect the motor 204 to the hydraulic circuit of a machine to which the work implement is attached. In some embodiments, check valves, relief valves, and other hydraulic components are also disposed in the mounting plate 270, 270', thereby to further reduce externally mounted hydraulic connections. Still further, in some embodiments, a hollow hydraulic shaft 400 may be provided through which hydraulic fluid flows, thereby to form part of the hydraulic fluid system of the work implement.

Figure 9:
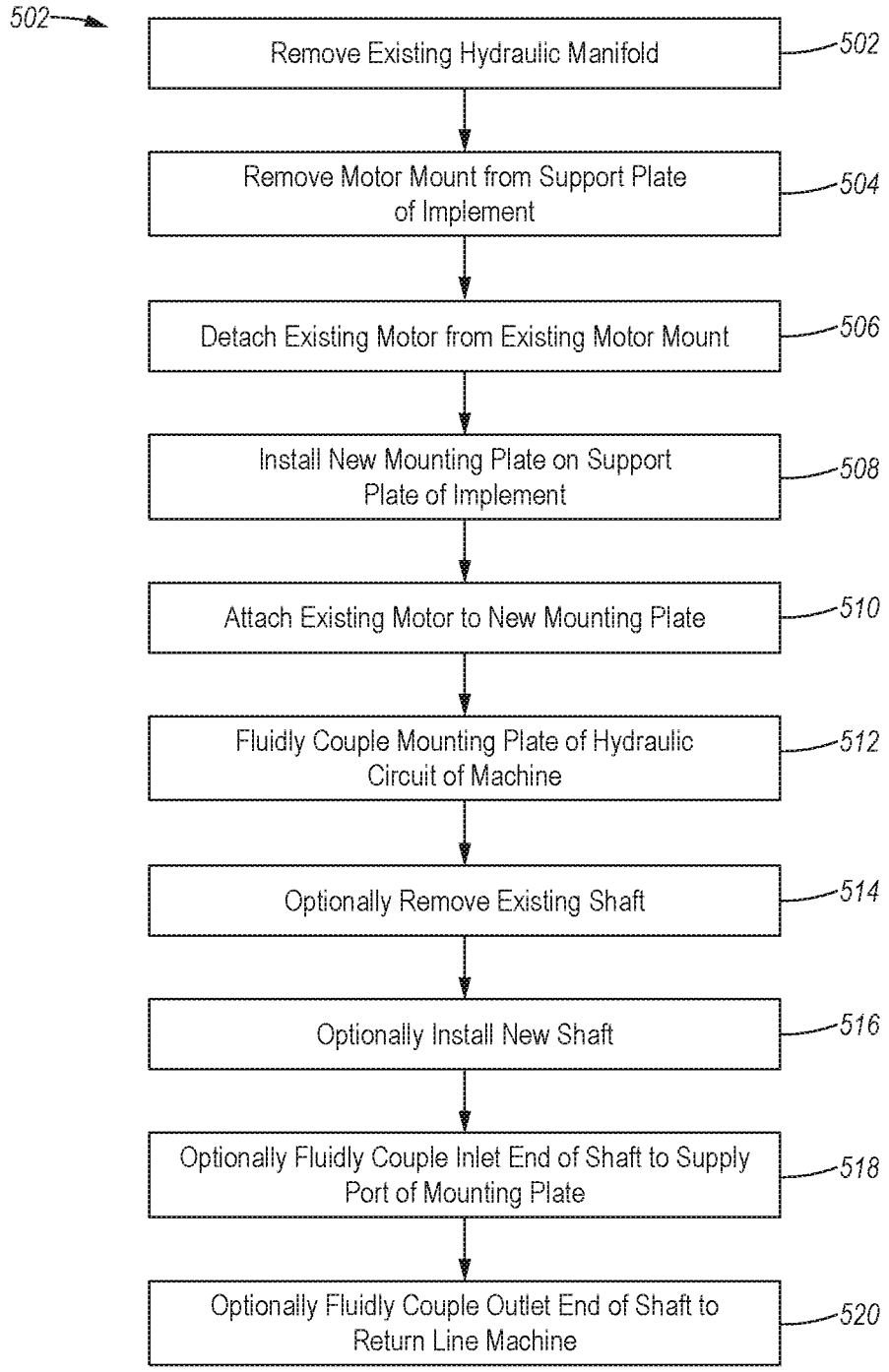
FIG. 9 is a flowchart illustrating a method of retro-fitting a hydraulic work implement with a mounting plate and optional shaft.

While the mounting plates 270, 270' may be provided in entirely new constructions, they may also be used in methods of retro-fitting an existing hydraulic work implement, as schematically illustrated in FIG. 9. In the exemplary method 500, an existing, external hydraulic manifold may be removed from the work implement at block 502. Such existing manifolds are often mounted to the upper portion 224 of the work implement, and therefore are connected by additional hoses to the motor 204. At block 504, an existing motor mount is removed from a support plate of the work implement. The existing motor mount does not have any conduits or other components used in the hydraulic fluid system of the implement, but instead only serves to support the motor 204. Next, at block 506, the existing motor is detached from the existing motor mount.

Continuing at block 508, a new mounting plate 270, 270' is installed onto the support plate 231 of the implement. The new mounting plate 270, 270' may be constructed as described above to include the body 281 defining the exterior surface 282 with mounting portion 284, the supply conduit 300 extending through the body 281 from the first supply port 302 formed in the exterior surface 282 to the second supply port 304 formed in the exterior surface 282, and the return conduit 310 extending through the body 281 from the first return port 312 formed in the exterior surface 282 to the second return port 314 formed in the exterior surface 282. The existing motor is attached to the mounting portion 284 of the body 281 of the new mounting plate 270, 270' at block 510, so that the second supply port 304 is directly coupled to the inlet port 278 of the existing motor 204 and the first return port 312 is directly coupled to the outlet port 280 of the existing motor 204. In some embodiments, the existing motor may also be replaced by a new motor.

The method may continue at block 512 by fluidly coupling the first supply port 302 to the auxiliary hydraulic fluid supply line 201 of the machine and fluidly coupling the second return port 314 to the auxiliary hydraulic fluid return line 203 of the machine, thereby to connect the hydraulic fluid system of the work implement to the hydraulic circuit of the machine.

In some embodiments, the method of retrofitting a work implement may further include removing an existing shaft 258 that is coupled to the motor 204 at block 514, and installing a new shaft 400 into the hydraulic work implement, at block 516. The new shaft 400 may define the shaft conduit 402 having an inlet end 404 and an outlet end 406. At block 518, the inlet end 402 of the shaft conduit 402 is fluidly coupled to the second supply port 314 of the return conduit. In this embodiment, the outlet end 406 of the shaft conduit 402 is fluidly coupled to the auxiliary hydraulic fluid return line 203 of the machine, as noted at block 520, while the first supply port 302 is fluidly coupled to the auxiliary hydraulic fluid supply line 201 of the machine, as noted above. Still further, in this embodiment a check valve 412 is installed in the shaft conduit 402 and oriented to permit fluid flow only from the inlet end 404 of the shaft conduit 402 to the outlet end 406 of the shaft conduit 402, at block 422.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A hydraulic fluid system for a work implement having a support plate and provided on a machine having an auxiliary hydraulic fluid supply line and an auxiliary hydraulic fluid return line, the hydraulic fluid system comprising:

a motor having an inlet port and an outlet port;

a mounting plate coupled to the support plate of the implement, the mounting plate including:

a body defining an exterior surface including a mounting portion coupled to the motor;

a supply conduit extending through the body from a first supply port, formed in the exterior surface and configured to fluidly communicate with the auxiliary hydraulic fluid supply line, to a second supply port, formed in the exterior surface and coupled to the inlet port of the motor;

a return conduit extending through the body from a first return port, formed in the exterior surface and coupled to the outlet port of the motor, and a second return port, formed in the exterior surface and configured to fluidly communicate with the auxiliary hydraulic fluid return line; and wherein the mounting plate further defines a bypass conduit formed at least partially in the body and fluidly communicating between the supply conduit and the return conduit.

2. The hydraulic fluid system of claim 1, in which the exterior surface of the body of the mounting plate further includes an internal face, an external face defining the mounting portion, a central bore extending entirely through the body from the external face to the internal face, and a side wall opposite of the central bore, and in which the first supply port and second return port are formed in the side wall, and the second supply port and first return port are formed in the external face.

3. The hydraulic fluid system of claim 1, in which the mounting plate further defines an anti-cavitation conduit formed at least partially in the body and fluidly communicating between the supply conduit and the return conduit independent of the bypass conduit.

4. The hydraulic fluid system of claim 3, in which:

the mounting plate further defines a central bore extending entirely through the body;

the bypass conduit is at least partially defined by a first groove formed in the central bore; and the anti-cavitation conduit is at least partially defined by a second groove formed in the central bore independent of the first groove.

5. The hydraulic fluid system of claim 4, further comprising a bearing sleeve disposed in the central bore of the mounting plate and extending over the first and second grooves.

6. The hydraulic fluid system of claim 1, in which the mounting plate further defines a pressure relief conduit extending through the body and fluidly communicating between the supply conduit and the return conduit.

7. The hydraulic fluid system of claim 6, further comprising a pressure relief valve disposed in the pressure relief conduit.

8. The hydraulic fluid system of claim 1, further comprising a shaft of the work implement defining a shaft conduit having an inlet end fluidly communicating with the return conduit, and an outlet end fluidly communicating with the auxiliary hydraulic fluid return line.

9. The hydraulic fluid system of claim 8, further comprising a check valve disposed in the shaft conduit and configured to permit fluid flow only from the inlet end of the shaft conduit to the outlet end of the shaft conduit.

10. A kit for retrofitting a hydraulic fluid system for a work implement, the hydraulic fluid system including an existing motor coupled to a support plate of the work implement, the work implement being configured for use with a machine having an auxiliary hydraulic fluid supply line and an auxiliary hydraulic fluid return line, the kit comprising:

a mounting plate configured for coupling to the support plate of the implement, the mounting plate including:

a body defining an exterior surface including a mounting portion configured for coupling to the existing motor;

a supply conduit extending through the body from a first supply port, formed in the exterior surface and configured to fluidly communicate with the auxiliary hydraulic fluid supply line, to a second supply port, formed in the exterior surface and positioned to directly couple to an inlet port of the existing motor;

a return conduit extending through the body from a first return port, formed in the exterior surface and positioned to directly couple to an outlet port of the existing motor, and a second return port, formed in the exterior surface and configured to fluidly communicate with the auxiliary hydraulic fluid return line; and a shaft configured for attachment to an eccentric mass of the work implement, the shaft defining a shaft conduit having an inlet end fluidly communicating with the return conduit, and an outlet end fluidly communicating with the auxiliary hydraulic fluid return line.

11. The kit of claim 10, further comprising a check valve disposed in the shaft conduit and configured to permit fluid flow only from the inlet end of the shaft conduit to the outlet end of the shaft conduit.

12. The kit of claim 10, in which the mounting plate further defines a central bore extending entirely through the body, a bypass conduit is at least partially defined by a first groove formed in the central bore, and an anti-cavitation conduit is at least partially defined by a second groove formed in the central bore independent of the first groove, the kit further comprising a bearing sleeve disposed in the central bore of the mounting plate and extending over the first and second grooves.

13. The kit of claim 10, further comprising a new motor for replacing the existing motor, in which the mounting portion of the mounting plate is further configured for coupling to the new motor, the second supply port is positioned to directly couple to an inlet port of the new motor, and the first return port is positioned to directly couple to an outlet port of the new motor.

14. The kit of claim 13, in which the exterior surface of the body of the mounting plate further includes an external face defining the mounting portion and a side wall, and in which the first supply port and second return port are formed in the side wall, and the second supply port and first return port are formed in the external face.

15. A method of retro-fitting a hydraulic work implement having a support plate and provided on a machine having an auxiliary hydraulic fluid supply line and an auxiliary hydraulic fluid return line, the work implement further includes an existing shaft coupled to the existing motor, the method comprising:

removing an existing implement hydraulic manifold from the work implement;

removing an existing motor mount from the support plate of the work implement;

detaching an existing motor from the existing motor mount;

installing a new mounting plate onto the support plate of the implement, the new mounting plate including:

a body defining an exterior surface including a mounting surface;

a supply conduit extending through the body from a first supply port formed in the exterior surface to a second supply port formed in the exterior surface; and a return conduit extending through the body from a first return port formed in the exterior surface to a second return port formed in the exterior surface;

attaching the existing motor to the mounting surface of the body of the new mounting plate, so that the second supply port is directly coupled to an inlet port of the existing motor and the first return port is directly coupled to an outlet port of the existing motor;

removing the existing shaft from the hydraulic work implement;

installing a new shaft into the hydraulic work implement, the new shaft defining a shaft conduit having an inlet end and an outlet end;

fluidly coupling the inlet end of the shaft conduit to the second supply port of the supply conduit;

fluidly coupling the outlet end of the shaft conduit to the auxiliary hydraulic fluid return line of the machine; and fluidly coupling the first supply port to the auxiliary hydraulic fluid supply line of the machine.

16. The method of claim 15, further comprising fluidly coupling the first supply port to the auxiliary hydraulic fluid supply line of the machine and fluidly coupling the second return port to the auxiliary hydraulic fluid return line of the machine.

17. The method of claim 15, further comprising installing a check valve in the shaft conduit oriented to permit fluid flow only from the inlet end of the shaft conduit to the outlet end of the shaft conduit.

* * * * *